US005601423A

United States Patent [19]

Meece et al.

[11] Patent Number: 5,601,423

[45] Date of Patent: Feb. 11, 1997

[54] HIGH CLEARANCE SLIDING VANE PUMP

[75] Inventors: Meredith W. Meece; William T. Thurmon; Richard G. Dupree, all of Monroe, La.

[73] Assignee: Thomas Industries Inc., Monroe, La.

[21] Appl. No.: 537,555

[22] Filed: Oct. 2, 1995

[51] Int. Cl.[6] ..... F01C 19/08

[52] U.S. Cl. ..... 418/131; 418/133

[58] Field of Search ..... 418/131, 132, 418/133

[56] References Cited

U.S. PATENT DOCUMENTS 3,695,791 10/1972 Brundage ..... 418/131

4,061,446 12/1977 Sakamaki et al. ..... 418/133

4,198,195 4/1980 Sakamaki et al. ..... 418/133

FOREIGN PATENT DOCUMENTS 2902301 8/1979 Germany ..... 418/131

*Primary Examiner*—Charles G. Freay

*Attorney, Agent, or Firm*—Quarles & Brady

[57] ABSTRACT

A sliding vane air pump has a resilient flexible plate secured to the housing adjacent to one end of the rotor so that drawing a high vacuum flexes the plate closer to the rotor to further increase the vacuum attainable by the pump.

5 Claims, 1 Drawing Sheet

HIGH CLEARANCE SLIDING VANE PUMP

FIELD OF THE INVENTION

This invention relates to sliding vane pumps.

BACKGROUND OF THE INVENTION

Sliding vane pumps are well known. Such pumps typically have a plurality of vanes slidably retained in radial slots of a rotor. The rotor has an axis about which it is rotated and which is eccentric to the axis of a cylinder in which the rotor is positioned. This creates a crescent shaped space between the rotor and the cylinder. When the rotor is rotated, the outer ends of the vanes follow the wall of the cylinder so that on one side of the rotor the pockets defined between the vanes increase in volume and on the other side of the rotor the pockets decrease in volume. An intake port of the pump is provided to the cylinder on the increasing side of the rotor, and an exhaust port is provided in the cylinder on the decreasing side. Thus, as the rotor is rotated, a gas or vapor is drawn into the intake and expelled through the exhaust.

In some applications of such a pump, for example as a vapor recovery pump for use in pumping liquid gasoline into the tank of an automobile at a gasoline station, the pump is required to operate pumping a vapor at sub-zero temperatures without seizing due to ice and frost accumulation inside the pump. To permit that, relatively large clearances are desirable. Such clearances are also desirable to reduce the failure rate due to inhaling debris.

However, a disadvantage of greater internal clearances is a reduction in the vacuum level capability of the pump. For example, in a gasoline vapor recovery system, it is known to sense the electric motor current which increases with increasing vacuum, and shut the system down when the current reaches a level that would indicate a blocked pipe. However, it is possible for the clearances inside the pump to be so great that such a high vacuum level cannot be reached, even if a pipe is blocked, so that the sensor does not perform its intended function.

SUMMARY OF THE INVENTION

The invention provides an improvement in a sliding vane pump of the type having a housing, a rotor received in a cylinder defined in the housing, the rotor having an axis which is eccentric to the cylinder, vanes slidable in slots in the rotor so as to follow the cylinder when the rotor is rotated about its axis, and a rotary drive shaft for rotating the rotor about its axis. The improvement is that a diaphragm plate is secured to the housing adjacent to and generally parallel with an end of the rotor, the plate being resilient so as to deflect axially closer to the rotor as a vacuum drawn by the pump increases and to retract axially away from the rotor as the vacuum subsides. Thus, during normal operation, the vacuum drawn by the pump is not sufficient to significantly reduce the axial clearance between the rotor and the plate. However, when a high vacuum is drawn, the plate flexes toward the end face of the rotor to reduce the axial spacing. This reduces leakage around the ends of the vanes and past the end of the rotor, which would otherwise limit the level of the vacuum the pump is capable of. Thus, a higher vacuum is attainable, while still maintaining a relatively high clearance at start up of the pump and during normal operation.

DETAILED DESCRIPTION OF THE PREFERRED EMBODIMENTS

Figure 1:
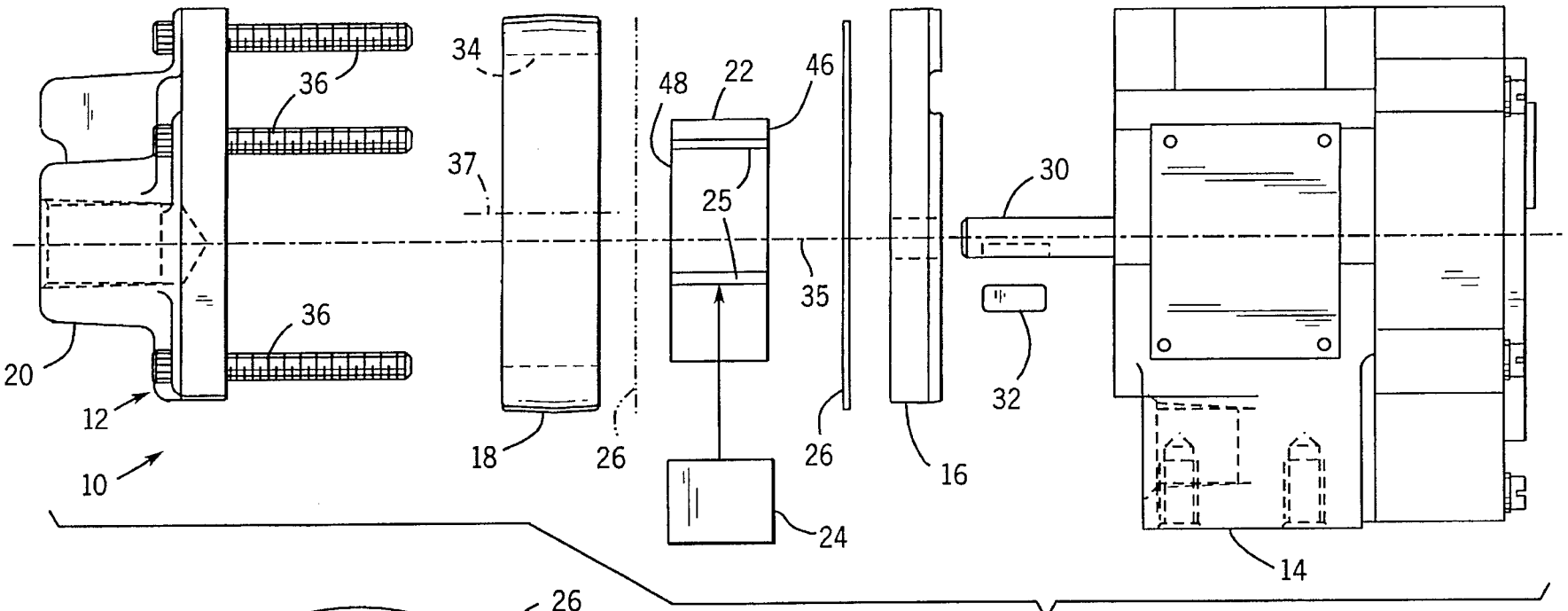
FIG. 1 is an exploded side plan view of a pump incorporating the invention.

FIG. 1 illustrates a side plan exploded view of a sliding vane air pump 10 incorporating the invention. Sliding vane air pumps are well known and the invention is not limited to any particular one of them. For example, the invention could be practiced with the sliding vane air pump described in abandoned, commonly owned U.S. patent application Ser. No. 08/188,761, the disclosure of which is hereby incorporated by reference.

The pump 10 has a housing 12 which includes the housing of electric motor 14, adapter 16, cylinder 18, and head 20. As is conventional in sliding vane air pumps, a rotor 22, and vanes 24, which slide in radial slots 25 of the rotor 22, are also provided. Non-conventionally, however, a resilient flexible diaphragm plate 26 is provided, as will be described in further detail below.

The motor 14 of the preferred embodiment is an electric motor of any suitable type. The motor 14 has a rotary power drive shaft 30 extending from it, which mounts rotor 22 by key 32 on shaft 30 in conventional fashion so as to rotate the rotor 22 about its axis 35.

As is well known in sliding vane air pumps, the cylinder 18 defines with its inner surface a cylinder 34, and the axis 35 of the drive shaft 30 and rotor 22 is eccentric with respect to the axis 37 of the cylinder 34, so as to define a crescent shaped space between the outer surface of the rotor 22 and the cylinder 34. As the rotor 22 is rotated, the vanes 24 slide in the slots 25 of the rotor so as to follow the surface of the cylinder 34, so that when the vanes are extending out of the slots, the volumes of the pockets between those vanes are expanding, and when the vanes are retracting back into the slots, the volumes of the pockets between the vanes is contracting. When the volume of a pocket is expanding, the pressure in that pocket is declining, and when a pocket is contracting in volume, its pressure is increasing. Thus, an intake port is provided in the head 20 opening into the crescent shaped chamber defined between the rotor 22 and cylinder 34 at a position in which the pocket volume is expanding, and an outlet port is formed in the head 20 opening into the crescent shaped chamber at a position in which the volume of the pockets is contracting.

The adapter 16 is provided so as to interface the motor 14 to the cylinder 18 and head 20. The adapter 16 is mounted to the motor 14, for example, with two screws (not shown) which extend through holes 44 in diaphragm 26 and corresponding holes in the adapter 16. This connection serves to secure these parts together in assembly while the rotor 22, vanes 24, cylinder 18 and head 20 are being assembled to the unit. Screws 36 (five total, only three are shown) extend through the head 20, cylinder 18, diaphragm 26 and adapter 16 and are threaded into the housing of the motor 14, to secure these parts together.

To avoid problems such as freezing up of the rotor at sub-zero temperatures or failures due to inhaling debris, it is desirable to provide relatively large clearances between the axially facing ends of the rotor 22 and the adapter 16 at one end, and the head 20 at the other end. However, large clearances at the ends of the rotor can detract from pump performance as they allow leakage past the edges of the rotor and past the end edges of the vanes 24. During most conditions of operation, the rotor 22 can be rotated fast enough to make up for leakage losses occasioned by the relatively large clearances, and thereby create a high enough vacuum to satisfy requirements. However, occasionally in the operation of the pump, it may be desirable to significantly increase the vacuum beyond that attainable with the particular motor 14 and fixed clearances at the ends of the rotor 22.

For example, if the pump is being operated as a vacuum pump and the intake to the pump becomes clogged, in a tight pump with low leakage losses, the vacuum will go up dramatically, resulting in a higher current to the motor. Some systems sense the current to the motor and when it goes up dramatically, due to a higher vacuum being drawn, appropriate action is taken, for example shutting down the system. However, where large clearances are provided in the pump, even if the intake line becomes clogged, the vacuum may not increase that much, since the flow inside the pump can just flow around the side edges of the vanes and the ends of the rotor to go from one vane chamber to another.

Figure 2:
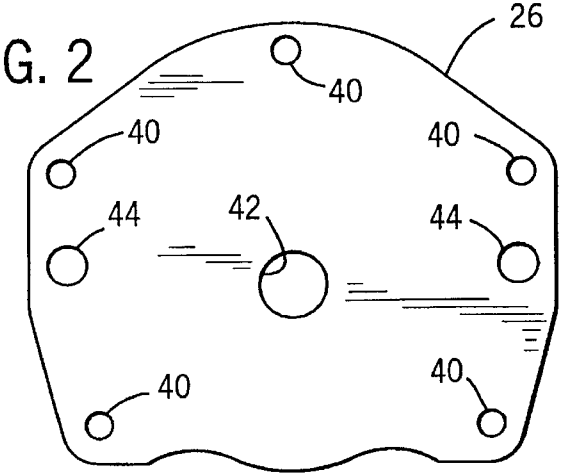
FIG. 2 is a front plan view of a diaphragm plate for use in the invention.

The invention solves this problem, while still providing the desirable large clearances at the ends of the rotor, by providing a diaphragm plate 26 adjacent to one or both ends of the rotor 22. As shown in FIG. 1, the diaphragm plate 26 is adjacent to the shaft end of the rotor 22. Referring to FIG. 2, the diaphragm plate 26 has the same outline as the cylinder 18, head 20 and adapter 16 and is secured by the previously mentioned screws extending through holes 44 and by the bolts 36, which extend through holes 40 in the plate 26. A shaft hole 42 is also provided in the plate 26 through which drive shaft 30 extends.

The plate 26 is made of a resilient flexible sheet material, for example, 0.012 inch thick stainless steel. With its outer periphery clamped between the cylinder 18 and the adapter 16, the inner area of the plate 26 is able to flex toward the shaft end face 46 of the rotor 22. The plate 26 moves closer to the shaft end face 46 of the rotor 22 as the vacuum drawn by the pump increases. In turn, as the plate 26 moves closer to the end of the rotor, thereby decreasing the effective clearance at the shaft end of the rotor, the vacuum which the pump is capable of drawing increases. The level of the vacuum at which the plate 26 starts to flex toward the rotor 22 and how much it flexes with increasing vacuum is determined by the stiffness of the material from which the plate 26 is made, as well as by mounting considerations, so essentially the plate can be designed to flex more or less as desired, depending upon the application. When the vacuum subsides, since the plate 26 is resilient, it returns to its normally planar state in which the clearance between the shaft end face of the rotor 22 is maximized, to prevent freezing up and clogging of the pump 10.

A diaphragm plate 26 could also be provided at the head end of the rotor 22, as shown by the plate 26 shown in phantom in FIG. 1, which would work in essentially the same manner as the plate 26 provided at the shaft end of the rotor. If provided at the head end, holes would have to be provided in the plate 26 through which the inlet ports and outlet ports could pass. It is desirable to place these holes adjacent to the external periphery of the plate 26 so as to minimize leakage which may occur directly between the intake and outlet on the head side of the plate 26 when the plate was bowed toward the head end 48 of the rotor 22.

Preferred embodiments of the invention have been described in considerable detail. Many modifications and variations to those preferred embodiments will be apparent to those skilled in the art which will still incorporate the invention. For example, the external shape of the plate 26 could be any shape, so long as it provided for axial flexing of the plate 26. Therefore, the invention should not be limited to the preferred embodiments described, which should be defined by the claims which follow.

We claim:

1. In a sliding vane vapor pump of the type having a housing, a rotor received in a cylinder defined in the housing, the rotor having an axis which is eccentric to the cylinder, vanes slidable in slots in the rotor so as to follow the cylinder when the rotor is rotated about its axis, and a rotary drive shaft for rotating the rotor about its axis, the improvement wherein a diaphragm plate is secured to the housing adjacent to, generally parallel with and spaced axially out of contact with an end of said rotor when said plate is relaxed, the plate being flat and resilient so as to flex to move an inner area of said plate axially closer to the rotor as a vacuum drawn by said pump increases to an abnormal operating level and to retract said inner area axially away from said rotor as said vacuum subsides to a normal operating level.

2. The improvement of claim 1, wherein said plate is adjacent to a shaft end of said rotor.

3. The improvement of claim 2, wherein said shaft extends through said plate.

4. The improvement of claim 1, wherein said plate is adjacent to a head end of said rotor.

5. The improvement of claim 1, wherein said plate is secured to said housing adjacent to the outer periphery of said plate.

* * * * *